US005365632A

United States Patent [19]

Kirchnavy

[11] Patent Number: 5,365,632

[45] Date of Patent: Nov. 22, 1994

[54] CLEAN-UP PAN

[76] Inventor: Dan J. Kirchnavy, 438 E. Gladstone, San Dimas, Calif. 91773

[21] Appl. No.: 128,091

[22] Filed: Sep. 29, 1993

[51] Int. Cl.[5] ..... A47L 13/52

[52] U.S. Cl. ..... 15/257.3; 15/257.7; 294/55; D32/74

[58] Field of Search ..... 15/257.1, 257.3, 257.7–257.9, 15/257.2, 257.4–257.6, 235.4, 236.01; 294/3.5, 55; D32/74

[56] References Cited

U.S. PATENT DOCUMENTS

| | | | |
|---|---|---|---|
| 218,997 | 8/1879 | Milligan | 15/257.8 |
| 236,501 | 1/1881 | Leix | 294/55 |
| 280,990 | 7/1883 | Wynkoop | 15/257.3 |
| 359,111 | 3/1887 | Vogel | 15/257.7 |
| 633,787 | 9/1899 | Brown . | |
| 720,761 | 2/1903 | Wade | 15/257.3 |
| 961,199 | 6/1910 | Armstrong | 15/257.3 |
| 996,341 | 6/1911 | Hutchison | 15/257.5 |
| 2,515,117 | 7/1950 | Duhaime | 15/257.3 |
| 2,617,281 | 11/1952 | Jones | 15/257.3 |
| 2,864,117 | 12/1958 | Williams . | |
| 3,156,941 | 11/1964 | Tomaiuolo | D32/74 |

FOREIGN PATENT DOCUMENTS

| | | | |
|---|---|---|---|
| 435142 | 2/1912 | France | 15/257.3 |
| 608886 | 8/1926 | France | 294/55 |
| 1262007 | 4/1981 | France | 15/257.3 |
| 890416 | 9/1953 | Germany | 15/257.3 |
| 163365 | 5/1958 | Sweden | 294/55 |
| 473 | 1/1889 | Switzerland | 15/257.3 |
| 242767 | 11/1925 | United Kingdom | 15/257.3 |
| 855622 | 12/1960 | United Kingdom | 294/3.5 |

*Primary Examiner*—David A. Scherbel
*Assistant Examiner*—Mark Spisich
*Attorney, Agent, or Firm*—Boniard I. Brown

[57] ABSTRACT

A clean-up pan has an arcuate trough-shaped bottom wall defining a side opening pouring spout for discharging material from the pan into a receiving receptacle. The bottom wall has a relatively large capacity, and its configuration reduces the likelihood of spillage when the pan contents are poured from the pan into a receiving receptacle.

19 Claims, 3 Drawing Sheets

CLEAN-UP PAN

BACKGROUND OF THE INVENTION

The present invention relates generally to clean-up pans, and more particularly to a clean-up pan having a side edge portion defining a pouring spout. In gathering waste, the pan of the invention is utilized in the general manner of conventional pans to accumulate thereon waste, such as trash, leaves, debris, etc. The accumulated waste is discharged from the pan by tilting it to gravitationally discharge it via the defined pouring spout.

A conventional debris or dust pan comprises a flat bottom wall having upstanding flanges or side walls on three of its four edges, and the fourth frontal edge forms an open mouth for accepting debris. A broom or rake may be used to sweep debris into the dust pan. The pan is emptied of accumulated trash or waste by tilting the pan forwardly and downwardly to lower the pan front edge to gravitationally discharge the waste material.

The flat bottom wall of a conventional dust pan is not satisfactory for discharge of accumulated debris. Accumulated debris is distributed along the length of the front edge of the pan bottom wall so that the discharged stream of debris tends to be relatively wide transversely of the pan. If a trash container or other receiving receptacle has a relatively small mouth, some of the debris will likely spill outside the receptacle. This spilling problem limits the width of the conventional dust pan and limits the pan capacity.

U.S. Pat. No. 2,864,117 to Williams partially overcomes the spilling problem with a pan comprising a flat bottom wall, a side wall extending upwardly from one side edge of the bottom wall, and a rear wall extending upwardly from the rear edge of the bottom wall. The other side edge of the pan bottom wall is exposed to form a side discharge opening. Trash can be discharged from the pan by tilting the pan downwardly to lower the exposed side edge of the pan to gravitationally discharge the trash through the pan side discharge opening.

The dust pan of Williams has a flange extending forwardly from the upper edge of the pan rear wall. Apparently, the flange acts as a debris retainer to prevent debris from overflowing the upper edge of the pan rear wall, especially when the pan is tilted to discharge debris from the pan bottom wall. One disadvantage of the flange is that it somewhat limits pan capacity. Also, the flange lies relatively close to the pan bottom wall so that debris can become lodged in the confined space between the flange and the pan bottom wall. Further, the flange involves a problem of cleanability of the dust pan. It would be difficult to insert a cleaning cloth or brush into the confined space between the pan bottom wall and the overlying flange.

A further disadvantage of the Williams dust pan results from the fact that debris or trash piled on the flat bottom wall will tend to gravitate from a pile and over the front edge or side edge of the pan, and prematurely spill out of the pan.

U.S. Pat. No. 633,787 to H. Brown shows a dust pan having a rectangular flat bottom wall, and upstanding walls extending along its rear edge and one side edge. A ridge is defined along the front edge of the pan bottom wall to prevent reverse movement of debris out of the pan front opening. A discharge opening is formed along the other side edge of the pan bottom wall, whereby accumulated debris can be discharged from the pan by tilting the pan in the direction of the discharge opening. A principal disadvantage of this dust pan is that debris piled on the flat bottom wall can gravitationally separate from the pile and prematurely spill out of the pan.

SUMMARY OF THE INVENTION

The present invention relates to a clean-up pan that has a side discharge opening and a bottom wall of trough-shaped configuration in a front-to-rear direction, i.e., a direction paralleling the side edges of the pan.

An advantage of the trough-shaped bottom wall is that a higher or deeper debris pile may be formed in the pan, and the effective capacity of the pan is increased. The trough-shaped bottom wall is further advantageous in that the debris is concentrated at or near the center of the trough; when the pan is tilted to discharge the accumulated waste, the debris stream will have a relatively small transverse width dimension and is therefore less likely to spill or bypass the receiving receptacle.

DESCRIPTION OF A PREFERRED EMBODIMENT OF THE INVENTION

Figure 1:
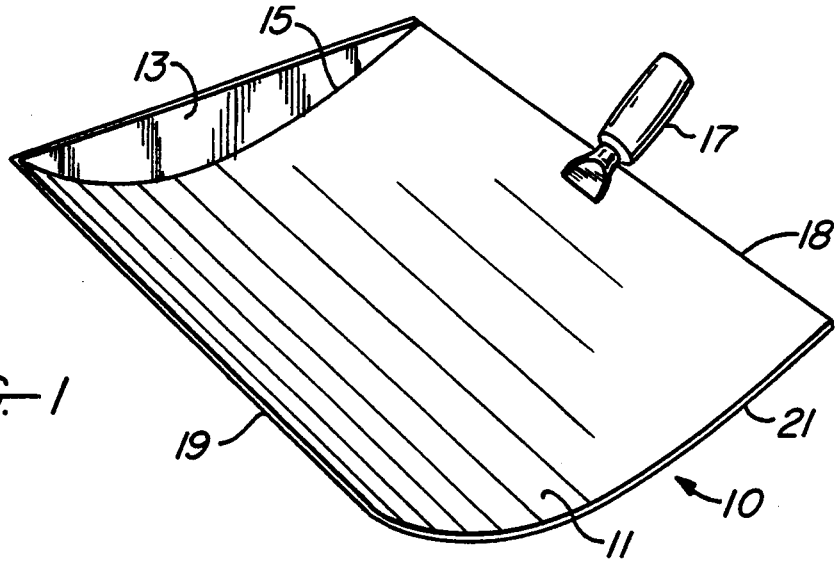
FIG. 1 is a perspective view of a clean-up pan according to the invention.

Referring to the drawings, FIG. 1 shows a three dimensional clean-up pan 10 adapted to receive and contain a range of wastes, e.g., dust, dirt, sawdust, trash, leaves, grass cuttings, and metal filings. The clean-up pan may be used in homes, yards, lawns, industrial facilities, construction sites, and other places where particular waste material is likely to accumulate. The waste may typically be swept into the clean-up pan with a broom, brush or rake.

Pan 10 comprises a trough-shaped bottom wall 11, and a single side wall 13 extending upwardly from a side edge 15 of the trough-shaped bottom wall, edge 15 forming the lower edge of side wall 13. A handle 17 is connected to the bottom wall at its rear edge 18.

Figure 2:
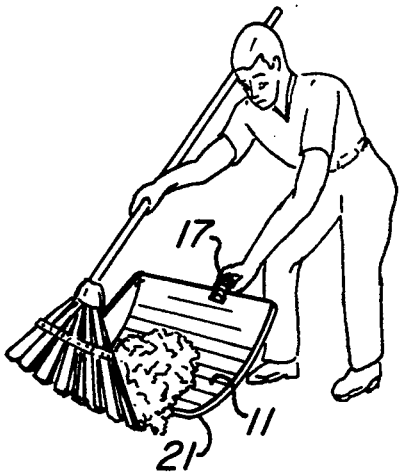
FIG 2 is a view showing the cleaning pan of FIG. 1 in use by a person raking leaves into the pan.
Figure 3:
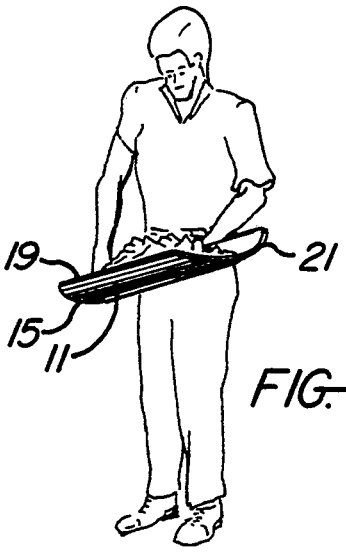
FIG. 3 shows pan of FIGS. 1 and 2 being lifted by a person prior to emptying the waste from the pan.

Front edge 19 is a straight edge forming the entrance opening for movement of debris into the pan. As shown in FIG. 2, a person can grasp handle 17 with one hand while manipulating a rake to move trash, leaves, twigs or other debris across straight edge 19 into the pan interior space.

Figure 4:
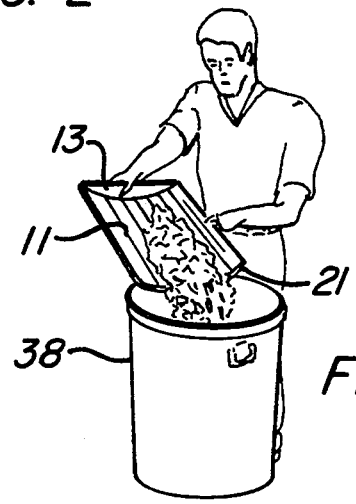
FIG. 4 shows the person manipulating the pan of FIGS. 1 and 2 to empty the pan contents into a trash receptacle.
Figure 6:
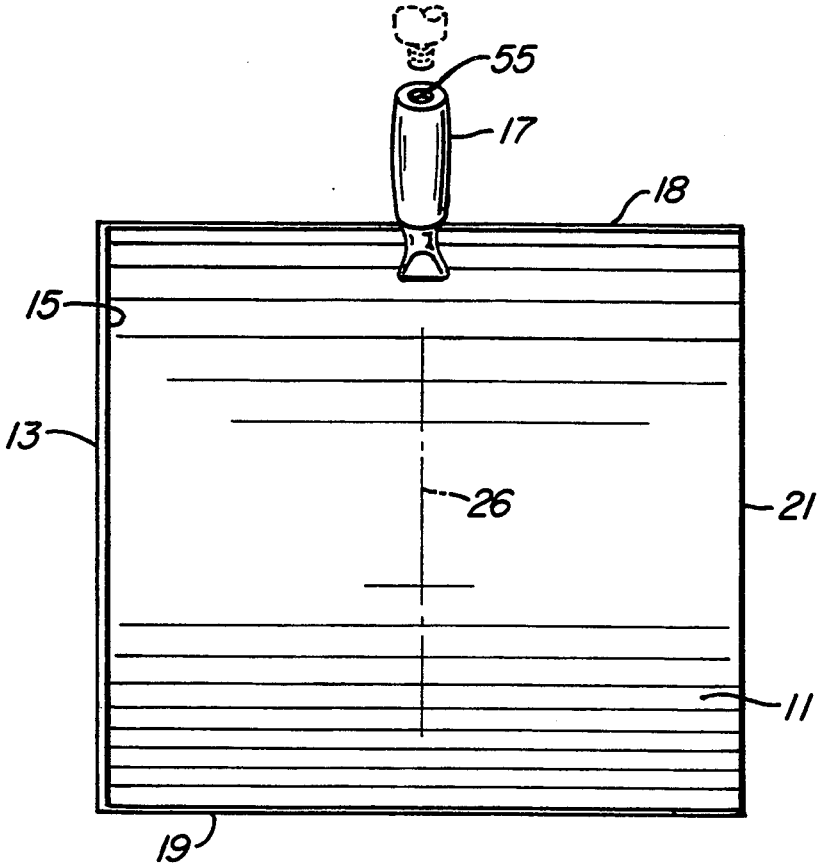
FIG. 6 is a top plan view of the pan of FIG. 5.

As shown in FIG. 6, the clean-up pan front and rear edges 19 and 18 are parallel to each other. Likewise, the two side edges 15 and 21 are parallel to each other. Side edge 21 is exposed and unconnected to any other structure, whereby the edge constitutes a pouring spout when the pan is tilted to the side, as shown in FIG. 4.

Figure 5:
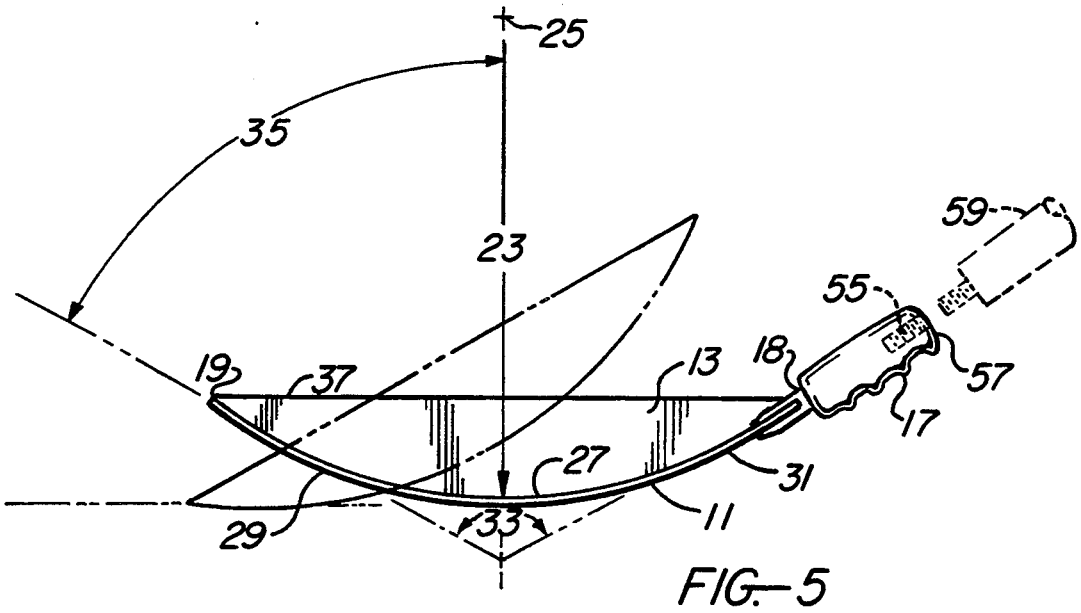
FIG. 5 is an end view of the clean-up pan of FIG. 1.

As viewed in FIG. 5, the pan bottom wall 11 is an arcuate wall having a shallow U-shaped cross section. The curvature of the arcuate wall is essentially constant from the front edge 19 to the rear edge 18. The radius of curvature 23 of wall 11 is generated from an imaginary axis 25, and all points along the surface of wall 11 are equidistant from this axis. The radius of curvature 23 is relatively large. For example, with edges 18 and 19 spaced apart about nineteen inches, the radius of curvature 23 may be about fifteen inches. With such dimensions, the spacing between side edges 15 and 21 may be about twenty inches.

The arcuate U-shaped cross section (FIG. 5) is disposed in an imaginary plane 26 (FIG. 6) parallel to side edges 16 and 21.

The arcuate U-shaped cross section, as shown, is symmetrical relative to an imaginary plane taken through axis 25 (coincident with line 23 in FIG. 5) and extending midway between the front and rear edges 19 and 18. The arcuate bottom wall 11 comprises a curved central wall portion 27 centered on the plane of radius line 23, and two end wall portions 29, 31 extending in opposite directions from wall portion 27 to form the front and rear edges 19 and 18. Because of the large radius of curvature 23, the end wall portions 29, 31 are essentially flat End wall portions 29, 31 are disposed at an acute angle to each other at an included angle 33 of about one hundred twenty degrees. The angle 35 between end wall portion 29 and the plane of symmetry 23 is about sixty degrees.

As shown in FIG. 5, the upper edge 37 of side wall 13 is a straight edge extending between the front and rear edges 19 and 18 of bottom wall 11, thus to close one end of the trough-shaped space. The opposite end of the trough-shaped space, defined by side edge 21, forms a pouring spout. FIG. 4 illustrates how the clean-up pan may be tiled to one side to discharge waste or debris from the pan into a conventional trash receptacle 38.

The conventional receptacle 38 commonly has a mouth opening diameter of about twenty inches. With a clean-up pan front-to-rear dimension of about nineteen inches, the pan fits into the mouth opening of receptacle 38 so that all of the trash or debris pouring from the pan (FIG. 4) is captured by the receptacle, without spillage outside the receptacle.

The height of side wall 13, measured in the plane of line 23, may be about three inches, which height is sufficient for containment of a considerable volume of waste or debris. Because of the U-shaped nature of bottom wall 11, the debris tends to collect or concentrate in the central portion of the pan, i.e., the zone above the curved central wall portion 27 (FIG. 5). Initially, the pan is tilted forwardly to receive the waste and debris via the front edge 19 of the pan bottom wall, as shown in broken lines in FIG. 5. When the pan is rocked back to the full line position (FIG. 5), the debris tends to gravitate to a central portion of the trough configuration.

Figure 9:
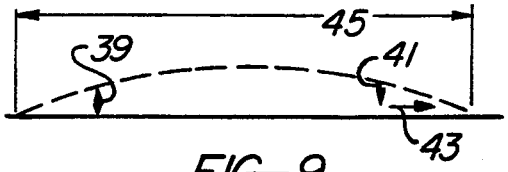
FIGS. 9 and 10 are diagrammatic illustrations of debris piles formed on a flat surface and on a trough-shaped surface, respectively.
Figure 10:
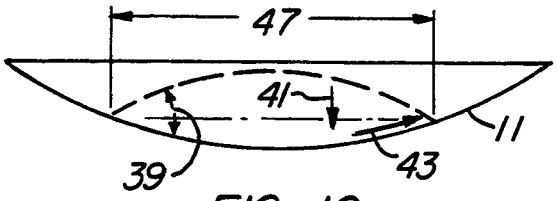

One advantage of the curved U-shaped pan construction is an increased waste capacity. FIGS. 9 and 10 show generally the debris piled on a conventional flat pan surface (as in FIG. 9) in comparison with that piled on the concave curved surface of the invention (as in FIG. 10). The angle of repose 39 of the debris pile is somewhat less for the flat surface, as compared to the concave trough surface, because of the fact that the particulate material has to climb up the inclined trough surface in order to separate from the pile. In FIGS. 9 and 10 the gravitational force line is indicated by arrow 41, whereas the direction of separation from the pile is indicated by arrow 43. The debris accumulating in the trough-shaped pan (FIG. 10) can thus be piled higher than debris piled on the flat surface.

The practical limit on capacity is thus significantly greater for the trough-shaped pan, at least partly because of the ability to form a higher or deeper pile. Also, the trough shaped pan tends to concentrate the debris near the center plane of the trough, whereas the flat pan surface tends to produce a wider, less concentrated pile. In FIGS. 9 and 10 the widths of the respective debris piles are indicated by the dimensions 45 and 47.

The more concentrated debris condition produced by the trough-shaped pan is advantageous in that when the debris is poured from the pan, the transverse width of the debris stream is reduced, with a reduced danger of spillage outside the receiving receptacle 38.

Figure 7:
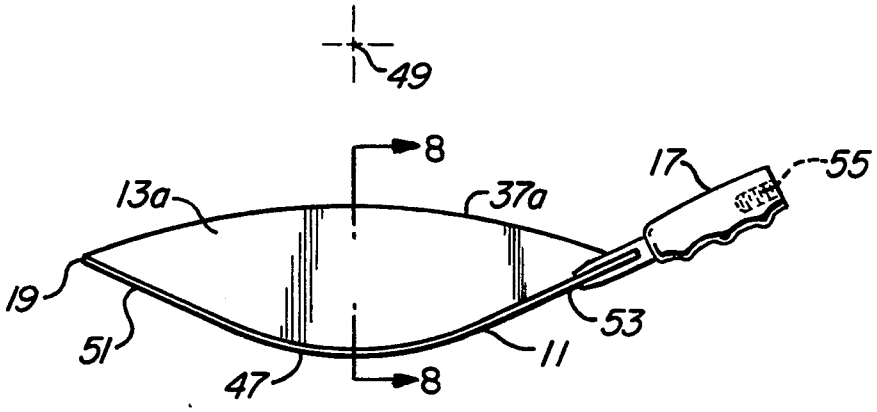
FIG. 7 is a view taken in the direction of FIG. 5, illustrating another embodiment of the invention.
Figure 8:
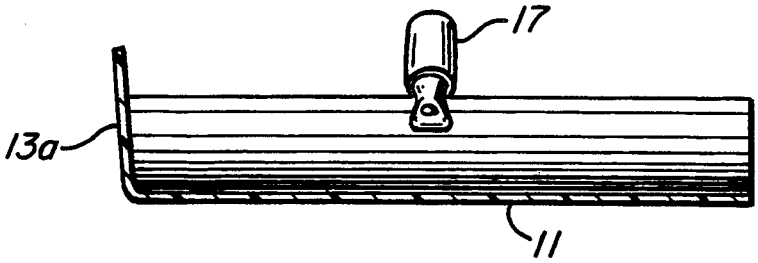
FIG. 8 is a transverse sectional view taken on line 8—8 in FIG. 7.

FIGS. 7 and 8 illustrate another embodiment of the invention, wherein the U-shaped bottom wall 11 of the clean-up pan has a curved central portion 47 centered on an imaginary axis 49. The end wall portions 51 and 53 of the pan bottom wall are flat.

The pan of FIGS. 7 and 8 further differs from the pan of FIG. 5 in that the upper edge **37*a* of the pan side wall 13*a* has a curved convex configuration. This somewhat increases the debris capacity of the pan. The pan of FIGS. 7 and 8** is generally used in the same manner as the earlier-described pan.

The clean-up pan may be formed of various materials. The pan of FIGS. 1 through 6 may be formed of sheet aluminum. Bottom wall 11 is curved to a desired curvature, and then attached to the lower edge of wall 13, as by electron beam welding.

The clean-up pan of FIGS. 7 and 8 may be molded out of plastic material.

Handle 17 is preferably formed separately from bottom wall 11, and attached by rivets and/or adhesives to the pan bottom wall. As an optional feature, the handle may be formed with a threaded hole 55 extending from its end surface 57 and adapted for threaded connection to the threaded end of an elongated rod 59, whereby the rod forms an elongated handle for the clean-up pan for use as a shovel.

Thus there has been shown and described a novel clean-up pan which fulfills all the objects and advantages sought therefor. Many changes, modifications, variations and other uses and applications of the subject invention will ,however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

The inventor claims:

1. A clean-up pan comprising:

a pan body having a trough-shaped bottom wall with a front edge, a rear edge, and first and second opposite side edges, the cross-sectional configuration of the bottom wall is defined in a first imaginary plane parallel to its side edges and generally symmetrical relative to a second imaginary plane disposed intermediate said front and rear edges, said cross-section of the bottom wall is of concave curved configuration centered on an axis coincident with said second imaginary plane, said first side edge of the bottom wall defining a pouring spout, a side wall extending from the second side edge of the bottom wall, and a handle on the bottom wall.

2. A clean-up pan according to claim 1, wherein:

said handle has a threaded hole therein for threaded connection to an elongated shaft to adapt the pan for use as a shovel.

3. A clean-up pan according to claim 1, wherein:

the bottom wall has a radius of curvature of about fifteen inches.

4. A clean-up pan according to claim 1, wherein said side wall has a height of at least three inches measured in said second imaginary plane.

5. A clean-up pan according to claim 1, wherein:

the distance between said front and rear edges of the bottom wall is about the same as the distance between the side edges of the bottom wall.

6. A clean-up pan according to claim 1, wherein:

the bottom wall is spaced from said axis by a distance of somewhat less than the distance between the front and rear edges of the bottom wall.

7. A clean-up pan according to claim 1, wherein:

the spacing between said axis and the bottom wall is about fifteen inches, and the spacing between the front and rear edges of the bottom wall is about nineteen inches.

8. A clean-up pan according to claim 1, wherein:

the concave surface of the bottom wall is spaced from said axis by a distance somewhat less than the distance between the front and rear edges of the bottom wall.

9. A clean-up pan comprising:

a pan body having a trough-shaped bottom wall of generally U-shaped cross-section, a front edge, a rear edge, and first and second mutually parallel opposite side edges, the cross-sectional configuration of the bottom being defined in a first imaginary plane parallel to its side edges and generally symmetrical relative to a second imaginary plane intermediate said front and rear edges, said cross-section of the bottom wall is of concave curved configuration centered on an axis coincident with said second imaginary plane, said first side edge of the bottom wall defining a pouring spout, a side wall extending from the second side edge of the bottom wall, and a handle extending from the rear edge of the bottom wall.

10. A clean-up pan according to claim 9, wherein:

the U-shaped cross-sectional configuration has front and rear edge portions disposed at an included angle of about one hundred twenty degrees to each other.

11. A clean-up pan comprising:

a pan body having a bottom wall generally trough-shaped when facing upwardly, and having a front edge, a rear edge, and first and second opposite side edges, the trough-shaped bottom wall having a generally U-shaped cross-sectional configuration defined in an imaginary plane intermediate said side edges and centered on an axis coincident with a second imaginary plane intermediate the front and rear edges, said first side edge of the bottom wall defining a pouring spout for trash and the like, a side wall extending upwardly from the second side edge of the bottom wall, and a handle extending from the rear edge of the bottom wall.

12. A clean-up pan according to claim 11, wherein:

said handle has a threaded portion for threaded connection to an elongated shaft to adapt the pan for use as a shovel.

13. A clean-up pan according to claim 11, wherein:

the bottom wall has a radius of curvature of about fifteen inches.

14. A clean-up pan according to claim 11, wherein:

said side wall has a height of at least three inches measured in said second imaginary plane.

15. A clean-up pan according to claim 11, wherein:

the distance between said front and rear edges of the bottom wall is about the same as the distance between the side edges of the bottom wall.

16. A clean-up pan according to claim 11, wherein:

the U-shaped bottom wall is spaced from said axis by a distance of somewhat less than the distance between the front and rear edges of the bottom wall.

17. A clean-up pan according to claim 11, wherein:

the spacing between said axis and the bottom wall is about fifteen inches, and the spacing between the front and rear edges of the bottom wall is about nineteen inches.

18. A clean-up pan according to claim 11, wherein:

the bottom wall is spaced from said axis by a distance somewhat less than the distance between the front and rear edges of the bottom wall.

19. A clean-up pan according to claim 18, wherein:

the spacing between said axis and the bottom wall is about fifteen inches, and the spacing between the front and rear edges of the bottom wall is about nineteen inches.

* * * * *